US006634993B1

(12) United States Patent
Morr

(10) Patent No.: US 6,634,993 B1
(45) Date of Patent: Oct. 21, 2003

(54) SWIMMER'S RESTRAINING DEVICE

(76) Inventor: James J. Morr, 505 Seabreeze Cir., Panama City Beach, FL (US) 32413

( * ) Notice: Subject to any disclaimer, the term of this patent is extended or adjusted under 35 U.S.C. 154(b) by 73 days.

(21) Appl. No.: 09/922,258

(22) Filed: Aug. 6, 2001

Related U.S. Application Data

(60) Provisional application No. 60/227,035, filed on Aug. 23, 2000.

(51) Int. Cl.[7] ..... A63B 31/00

(52) U.S. Cl. ..... 482/55; 482/124; 434/254

(58) Field of Search ..... 482/55, 56, 111, 482/112, 124; 434/247, 254; D21/804, 805, 807, 808

(56) References Cited

U.S. PATENT DOCUMENTS 4,544,155 A * 10/1985 Wallenbrock et al. ..... 482/129
5,391,080 A * 2/1995 Bernacki et al. ..... 434/254
5,490,823 A * 2/1996 Awbrey et al. ..... 482/55
5,846,167 A * 12/1998 Liu et al. ..... 482/55
5,938,565 A * 8/1999 Bernacki ..... 482/5

* cited by examiner

*Primary Examiner*—Nicholas D. Lucchesi
*Assistant Examiner*—Tam Nguyen
(74) *Attorney, Agent, or Firm*—William B. Noll

(57) ABSTRACT

A swimmer's restraining device to facilitate water exercising by a swimmer in a confined swimming location. The device comprises a flexible tethering cord to be attached to a fixed location on or about the swimming location, a flotation member, and a pair of fixed lines, each secured at one end to the tethering cord with the opposite ends attached to the soles of the swimmer's wading shoes. This device frees the swimmer's arms and legs for full exercising movement.

8 Claims, 2 Drawing Sheets

SWIMMER'S RESTRAINING DEVICE

RELATED APPLICATION

This application is based on and claims priority of U.S. Provisional Application, Ser. No. 60/227,035, filed Aug. 23, 2000, by the inventor hereof and under the same title.

FIELD OF THE INVENTION

This invention is directed to the field of swimming aids, more particularly to a device for holding a swimmer within a pool while exercising or training. By a unique construction, the device gives the swimmer freedom of arm movement and leg kicks.

BACKGROUND OF THE INVENTION

The present invention is directed to a restraining device that may be used by a swimmer for exercising and/or rehabilitation, such as for a back injury and the like. Swimming is an exercise that is recommended by medical personnel for a variety of reasons. Unfortunately, there are few available places for one to gain the exercise desired. Back yard pools are too small to provide the much needed exercise. The prior art has recognized the need to provide some means to help restrain a swimmer, where the device may be used in a small pool. Exemplary prior art to help a swimmer to swim "in place" is reflected in the following U.S. patents:

a.) U.S. Pat. No. 5,083,522, to Ashrow, granted Jan. 28, 1992, is directed to a swimming harness for holding a swimmer at a selected location in a body of water, such as a swimming pool, and giving the swimmer freedom of swimming movement. The harness comprises an elongated integral braided cord having an inner end which is secured to a fixed object located directly adjacent the swimming pool and an outer end which is connected, such as by a belt, to the swimmer. The elongated integral braided cord includes an enlarged section within which is mounted a stretchable resilient solid cord. The resilient cord functions to stretch whereby to substantially eliminate any jerking movements produced by the swimmer during the swimming motion. The enlarged section of cord that surrounds the resilient solid cord is capable of being expanded a limited amount thereby functioning as a stretch limited for the resilient solid cord.

b.) U.S. Pat. No. 4,577,859, to Gossett, granted Mar. 25, 1986, teaches apparatus for in-place swimming. The apparatus includes a swimming enclosure to which is tethered a belt for encircling the swimmer's waist.

c.) U.S. Pat. No. 4,524,711, to Ashrow, granted Jun. 25, 1985, relates to a swimming harness for holding a swimmer at a selected location in a swimming pool, yet giving the swimmer freedom of swimming movement. The harness comprises an elongated member, the inner end of which is attached to a fixed exterior object and the outer end of which is connected to a belt which is to be located about the waist of the swimmer. A resilient section is located between the inner and outer ends of the members to provide a limited amount of stretching movement.

d.) U.S. Pat. No. 4,247,096, to Schmitt, granted Jan. 27, 1981, is directed to a portable swimmer training apparatus. Such apparatus includes a flexible tether connected to a detachable, load distributing harness which is disposed about the waist of the swimmer. This provides the swimmer with a commodious means of shock-dampened restraint confining the swimmer to a particular area of the pool while allowing him/her maneuverability for the practice of various swimming strokes.

Each of the prior art devices is directed to a waist encircling device that is tethered to a fixed location in or about the pool. Unfortunately, with such waist devices, the tethering cord can interfere with leg kicks, an important requirement for a full exercising regimen. The present invention provides different means for tethering a flexible cord, where such cord does not interfere with the swimmer's foot actions. The manner by which this invention performs its function will become apparent in the description and drawing which follow.

SUMMARY OF THE INVENTION

The present invention relates to a swimmer's restraining device that may be used by a swimmer desiring to exercise and improve his swimming stroke in a confined swimming location. The unique construction of the device allows freedom of movement for the swimmer, no arm or leg restrictions. The device comprises a flexible tethering cord, of predetermined length, to be secured to a fixed structure in or about the swimming location. There is a flotation member about the cord to keep the cord at or near the water level, which further acts to resist the downward forces resulting from the load applied to the tethering cord. The free end of the tethering cord attaches a pair of fixed lines to be secured to the soles of the swimmer's wading shoes. The swimmer is thus restrained but whose arms and legs are free to move.

Accordingly, an object of this invention is to provide a restraining device for pool exercising that gives freedom of movement to the swimmer.

A further object hereof lies in the use of a swimmer's restraining device that incorporates an elastic cord with a flotation mechanism, where the flotation mechanism resists the downward forces resulting from the load applied to the elastic cord.

Another object hereof is the provision of a simple kit of components to readily assemble a swimmer's restraining device.

Still another object of the invention is to provide an effective water exercising device that requires only a limited area for swimming.

These and other objects of the invention will become more apparent in the description which follows, particularly when considered in conjunction with the accompanying drawings.

DETAILED DESCRIPTION OF PREFERRED EMBODIMENT

This invention is directed to a swimmer's restraining device that gives a swimmer an excellent opportunity to exercise and improve one's strength and upper body while swimming in a confined swimming location, with means that will not interfere with arm and leg movements. Turning now to the invention, as illustrated by the two Figures, like references used in the different Figures represent like components or features in the respective views.

Figure 1:
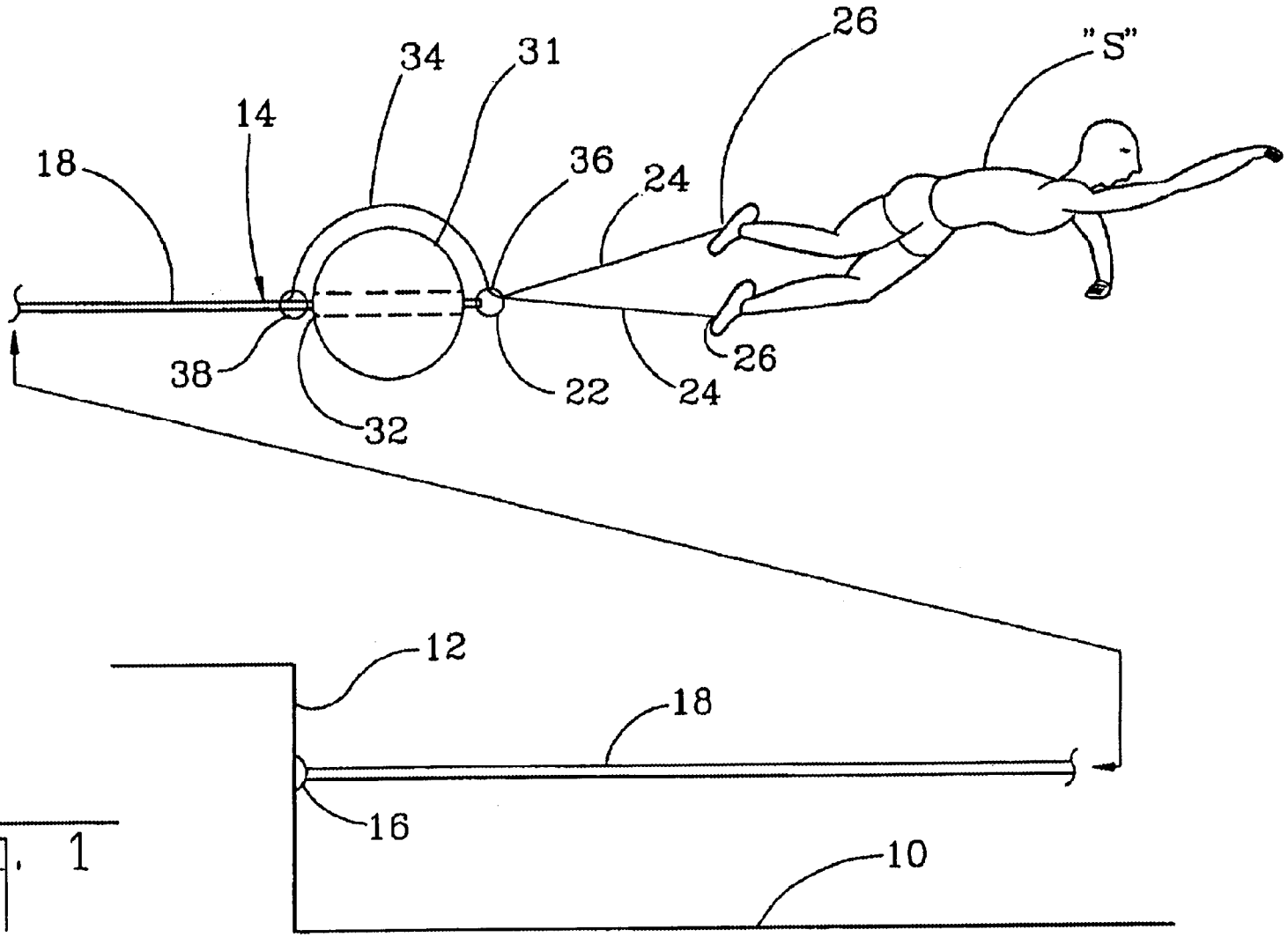
FIG. 1 illustrates the device of this invention in a simplified manner.
Figure 2:
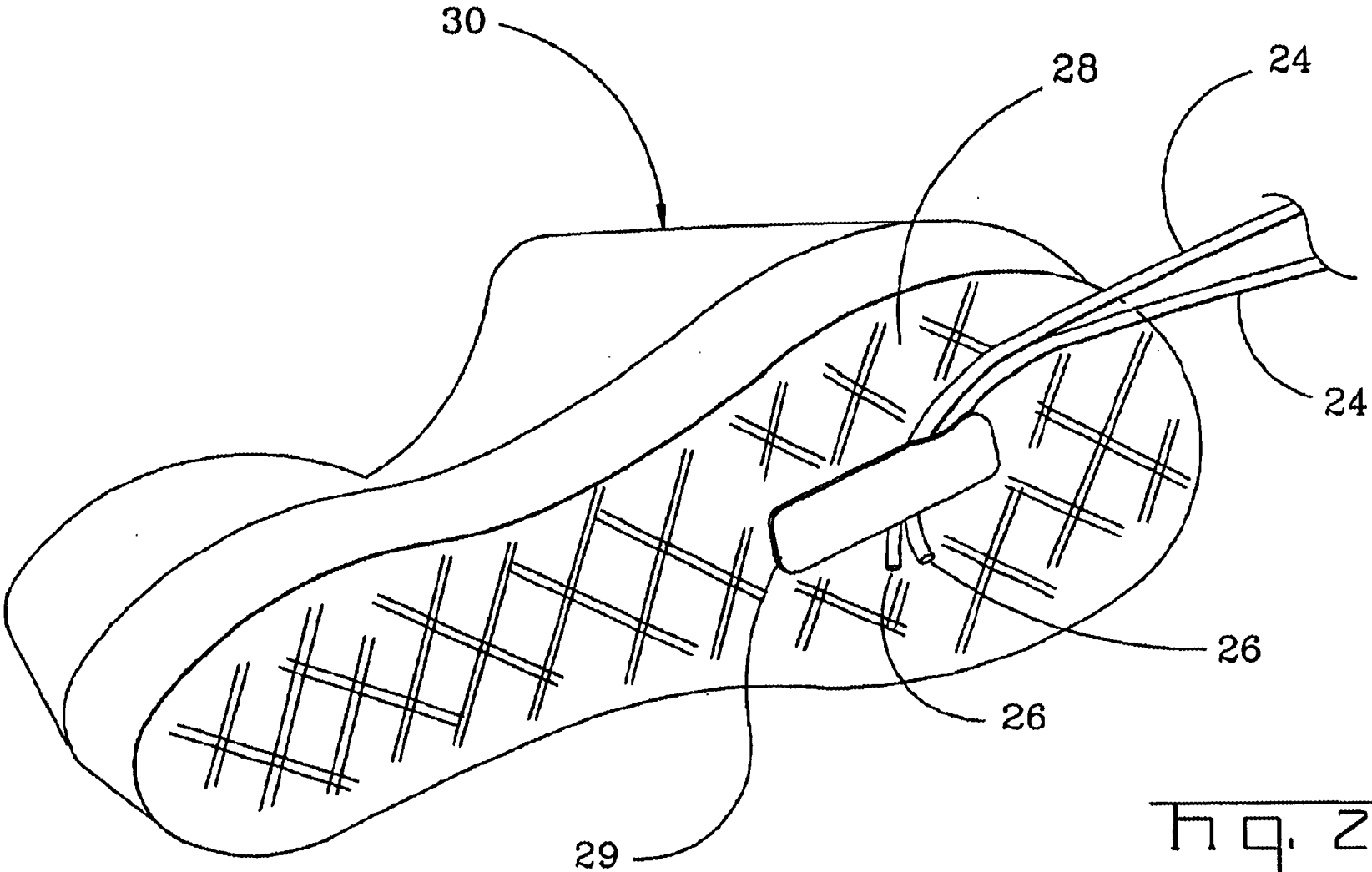
FIG. 2 shows the connection of a fixed length cord to the sole of a swimming shoe.

Referring first to FIG. 1, a partial swimming pool 10 is shown, where a swimmer "S" is preferably tethered to the pool wall 12 by the restraining device 14 of this invention. The tethering also may be to a pool ladder or railing, as found in most swimming pools, or to any convenient fixed structure, such that it may be readily transported to different swimming locations. In any case, the device 14 comprises a snap type hook 16, with an eyelet at one end, as known in the art, for attachment of the device to the pool wall 12. Secured to the snap type hook 16 is a stretchable or elastic cord 18, preferably with a braided nylon sheath. The opposite end 20 of the elastic cord may include a similar snap type hook 22 to which is secured two fixed lines 24 of predetermined length, where the securing end may include a loop, with a preferred length of about two to three feet.

The free ends 26 of the fixed lines are fixed to the sole 28 of the swimmer's wading shoes 30, at a midpoint or toe, for example, where a typical prior art shoe includes a rubberized sole. To securely attach the fixed lines 24 to the sole 28, without interfering with the swimmer's feet, a preferred manner of attachment is to vulcanize, or by the application of heat, a rubberized strip 29 holding the fixed lines to the sole 28. Alternatively, a water insoluble glue may be used, where such glues are known in the art. In either case, this provides a secure connection. By attaching the fixed lines 28 in this manner, the swimmer is afforded a full range of movement for all strokes. Additionally, with no attached pressure points to cause chaffing, it is more comfortable to the user.

To keep the swimmer "S" afloat, a flotation device 31 is provided on the elastic cord 18 by a through slot or channel 32. While the flotation device may be a light weight Styrofoam, or an inflated device, the former is illustrated in FIG. 1. To temporarily fix the position of the flotation device to the elastic cord, a wrap around cord 34 may be used. Specifically, one end 36 is secured to the snap hook 22 while the other end 38 overrides the flotation device to be secured to the elastic cord forward of the flotation device. Such flotation device is critical to the utility and function of the restraining device. Its presence resists the downward forces resulting from the load applied to the flexible elastic cord 18. The greater the load, the greater the downward force on the swimmer. Further, as a training or teaching aid, it is very important that the restraining device provides the swimmer the correct swimming position so as to not cause an improper leg kick or arm stroke to offset the downward force resulting from the load applied by swimming against the elastic cord 18.

With this device 14 secured to the soles of the swimmer's wading shoes, and with ample length to the fixed lines 24, the swimmer is free to use both arms and legs without interference. Further, with the swimmer essentially in a suspended animation mode, i.e. not moving forward through the water, the restraining device provides an excellent coaching aid, and to observe the swimmer's development, both above water and below the surface. Because of the limited space needed for the full use of the restraining device, a coach can easily observe and critique a number of swimmers in close proximity to one another.

It is recognized that changes, variations, and modifications may be made to the device of this invention without departing from the spirit and scope thereof. Accordingly, no limitation is intended to be imposed on the invention or kit of components to assemble the device hereof except as set forth in the accompanying claims.

What is claimed is:

1. An exercising and restraining device for tethering a swimmer to a fixed structure of a confined swimming location having a fixed wall, said device comprising a flexible tethering cord of predetermined length having a first means at a first end thereof for removable attachment to said wall, a flotation member slidably mounted on said cord, including means for restricting axial movement of said flotation member along said cord, second attachment means at a second end of said cord, said second attachment means mounted to first ends of a pair of fixed lines a pair of wading shoes that feature a generally flat sole portion, where the respective opposite ends of said fixed lines are attached to said generally flat sole portions of said wading shoes.

2. The exercising and restraining device according to claim 1, wherein said means for restricting axial movement of said flotation member is an encircling cord extending from said second attachment means to said cord in proximity to said flotation member.

3. The exercising and restraining device according to claim 1, wherein the means for attaching said cord to said wall and fixed lines are snap type hooks.

4. The exercising and restraining device according to claim 1, wherein each said fixed line is secured to a different said wading shoe by vulcanizing to the sole thereof.

5. A kit of components for assembling an exercising and restraining device for use in assisting a swimmer in exercising within a confined swimming location, said kit comprising:

a.) a flexible tethering cord of predetermined length having attachment means at its respective ends;

b.) a flotation member for sliding engagement with said cord;

c.) a small cord of a length to override said flotation device to restrict axial movement of said flotation member along said cord;

d.) a pair of fixed length lines for attachment to a first end of said tethering cord;

e.) a pair of wading shoes, to be worn by a swimmer, that feature flat soles; and f.) means to attach said fixed length lines to the flat sole of said pair of wading shoes.

6. The kit of components according to claim 5, wherein said flotation member is air inflatable.

7. The kit of components according to claim 5, wherein said attachment means at the respective ends of said cord are snap type hooks having eyelets at an end thereof.

8. The kit of components according to claim 7, wherein said fixed length lines include a loop for attachment to one of said snap type hooks.

* * * * *